United States Patent [19]

Kreikemeier

[11] Patent Number: 4,923,331

[45] Date of Patent: May 8, 1990

[54] COMPOSITE GROUND WATER DRAINABLE SYSTEM

[76] Inventor: John Kreikemeier, 175 Ranchette Rd., Alpharetta, Ga. 30201

[21] Appl. No.: 202,147

[22] Filed: Jun. 3, 1988

[51] Int. Cl.[5] ..... E02D 19/18

[52] U.S. Cl. ..... 405/45; 405/43; 405/36

[58] Field of Search ..... 405/36, 50, 45, 43

[56] References Cited

U.S. PATENT DOCUMENTS

| | | | |
|---|---|---|---|
| 870,433 | 11/1907 | Hodges | 405/50 |
| 3,654,765 | 4/1972 | Healy et al. | 405/45 |
| 4,490,072 | 12/1984 | Glasser | 405/45 |
| 4,650,367 | 3/1987 | Dietzler | 405/45 X |
| 4,730,953 | 3/1988 | Tarko | 405/50 X |
| 4,749,306 | 6/1988 | Demeny et al. | 405/50 X |

FOREIGN PATENT DOCUMENTS

| | | | |
|---|---|---|---|
| 2040655 | 9/1980 | United Kingdom | 405/50 |

OTHER PUBLICATIONS

"High Speed Drains", *Railway Engineer International,* vol. 5, No. 1, Jan./Feb. 1980, p. 6.

*Primary Examiner*—Randolph A. Reese
*Assistant Examiner*—J. Russell McBee
*Attorney, Agent, or Firm*—Hurt, Richardson, Garner, Todd & Cadenhead

[57] ABSTRACT

A composite ground water drainage system for foundation walls having an elongated drainpipe for placement along the bottom of a foundation wall and a base piece of a sheet of a textured, water impervious material for placement longitudinally along the foundation wall in a substantially vertical position between the foundation and the drainpipe both the drainpipe and the base piece being wrapped in a filter fabric, the fabric including a flap for wrapping around the base piece. A plurality of chimney assemblies are spaced along the base piece extending substantially upwardly and perpendicularly thereto, each chimney assembly also including a sheet of textured material and filter fabric wrapped around the textured material. To create a composite drainage and gas venting system, a vent may be added to one or more of the chimney assemblies, the vent extending from the top of the chimney assembly above the surface of the soil placed over the drainage system.

3 Claims, 2 Drawing Sheets

COMPOSITE GROUND WATER DRAINABLE SYSTEM

BACKGROUND OF THE INVENTION

1. Field of the Invention

This dual purpose invention pertains to a subterranean drainage system for draining water away from basement foundation walls and to assist in venting radon gas that may be present in soils adjacent to basement walls. The invention may also be used as a trench drain.

2. Prior Art

The conventional basement drainage system is a sand or gravel covered pipe drain. For a trench drain, the conventional drainage system requires digging a trench, inserting a drainage pipe into the trench and covering the pipe with either sand or gravel or both and backfilling with soil if necessary. Such a conventional drainage system can also be used against below grade structural foundations.

U.S. Pat. No. 4,490,072 to Glasser discloses a subterranean drainage device utilizing a core made of a stiff plastic sheet having rigid raised portions and alternate valleys. Wrapped around the core is an envelope of non-woven material sealed at its top and bottom. Sufficient space is provided in the bottom of the envelope to allow for the insertion of a drainage pipe having raised annular portions. When the pipe is in place within the envelope the raised annular portions contact the core. The envelope being sealed along its bottom before installation of the drain pipe makes installation more difficult and expensive. Long sections of pipe must be inserted through the envelope making installation more tedious and time consuming.

The patent to Healy et al., U.S. Pat. No. 3,654,765, discloses a subterranean wall drain including a continuous expanded plastic core. Pervious sheet material is bound to one side of the core and a plastic sheet or other vapor barrier forming material is bound to the opposite side of the core. In one embodiment the core and drainage pipe are formed of a single continuous sheet. In another embodiment the core is inserted into the drain pipe through a longitudinal slot in the pipe.

These drainage systems typically cover the entire wall surface of a below grade foundation using more material than is necessary to accomplish the task and are difficult to install. No known system accomplishes all of the objectives of the present invention with as little expense or its ease of installment.

SUMMARY OF THE INVENTION

It is, therefore, one object of the present invention to make more efficient use of the amount of the construction material employed in a ground water drainage and radon venting system while at the same time providing sufficient drainage and venting action, thus reducing the amount and cost of materials needed.

It is a further object of the present invention to provide a drainage system that is easy to install in modular pieces further reducing costs associated with installation of the drainage system.

It is still a further object of the present invention to provide a means for venting radon gas that may be present in soils adjacent to foundation walls, while at the same time drawing ground water away from the foundation walls.

The preferred embodiment of the ground water drainage system as described herein is characterized by a substantially rectangularly shaped, flexible sheet of netting material made of plastic or other non-corroding water impervious material wrapped in a sheet of non-woven filter fabric, such as "needle-punched" polypropylene fabric. The sheet of netting material has a top edge and a bottom edge and is generally longer than it is tall. The filter fabric is wrapped around the netting in a way such that one edge of the fabric is lined up with the bottom edge of the netting and covers the entire one side of the netting. The filter fabric extends from the bottom edge of the netting up one side of the netting, is wrapped over the top edge of the netting and extends down the opposite side of the netting such that the fabric extends well beyond the bottom edge of the netting from its opposite side. The fabric is bonded to the opposite side of the netting part way down from its top edge, thus leaving the fabric covering the bottom portion of the opposite side of the netting bottom edge unattached to the netting. The unattached portion of the fabric forms a free flap for wrapping around a drain pipe to be placed along side the bottom edge of the netting as described in more detail below.

When used as a basement drain or below grade wall drain, the system above is placed longitudinally along the base of the foundation or wall. Extending substantially perpendicularly from the top of the base piece of netting wrapped in the filter fabric are chimneys of similar netting, and wrapped in similar filter fabric. The chimneys are preferably spaced from four to six (4–6) feet, on centers, apart along the netting placed longitudinally against the base of the foundation or wall and act as capillaries draining water to the base piece of netting adjacent to the drain pipe. The rear side of all enveloped netting is glued to the foundation or wall.

One or more of the chimneys may be fitted with a vent, preferably in the form of a hollow, substantially rectangularly shaped duct, extending from the top of the chimney above the soil surface. The chimney/vent assembly allows water to flow down the chimney for drainage away from the foundation wall while simultaneously allowing radon gas in the soils adjacent the foundation wall to escape through the vent.

The advantages described herein and others will become apparent from the detailed description of the invention provided herein below.

DETAILED DESCRIPTION OF THE PREFERRED EMBODIMENT

A preferred exemplary embodiment of the invention is illustrated in FIGS. 1–5, wherein like numerals represent like parts.

Figure 1:
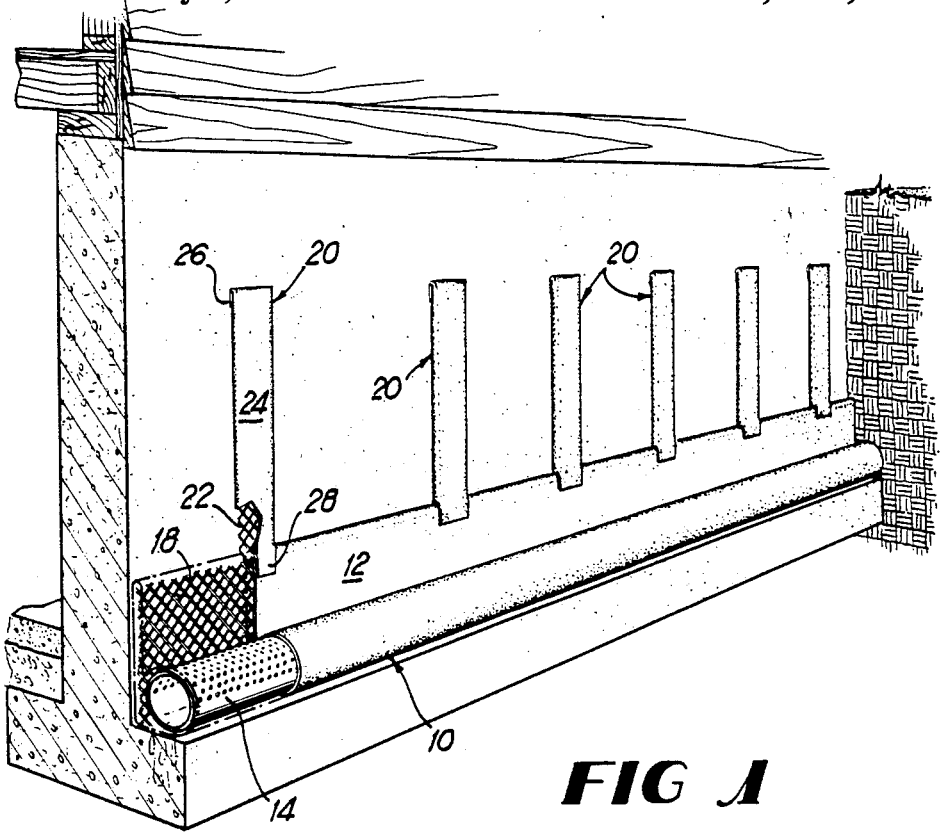
FIG. 1 is a perspective view of the drainage system of the present invention shown installed along a basement wall foundation with a portion cut away to expose the interior of the system.
Figure 3:
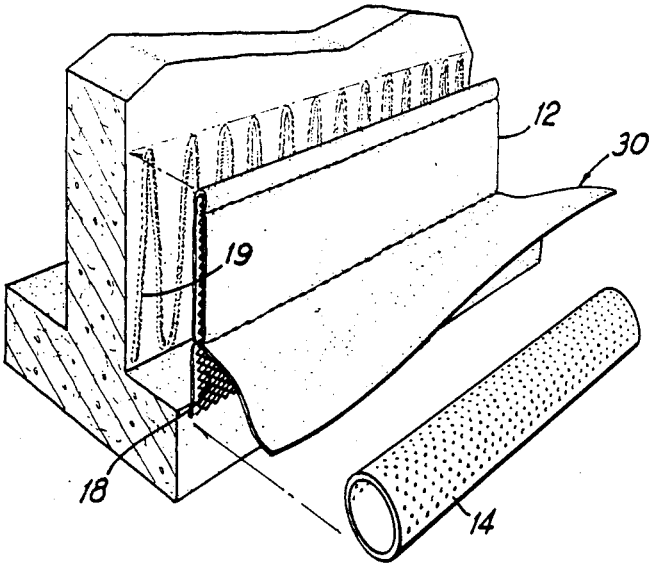
FIG. 3 is a perspective view of the main portion of the drainage system illustrating its installation along the footing of a wall foundation.

FIG. 1 shows a perspective view of the wall drain for a basement foundation as it would be installed next to a typical wall foundation. The wall drain includes a main assembly (10) with chimneys (20) extending therefrom which act as capillaries to the main assembly. The wall drain consists of a substantially rectangularly shaped base piece (18) of netting of a flexible waterproof material, such as plastic or other corrosive resistant material. The base piece (18) is wrapped in rot proof, non-woven filter fabric (12), such as "needle-punched" polypropylene fabric. The sheet of netting material has a top edge and a bottom edge and is generally longer than it is tall. As shown in FIG. 3, the filter fabric is wrapped around the netting in a way such that one edge of the fabric is lined up with the bottom edge of the netting and covers one entire side of the netting. The filter fabric (12) extends from the bottom edge of the netting up the one side of the netting, is wrapped over the top edge of the netting and extends down the opposite side of the netting such that the fabric extends well beyond the bottom edge of the netting from its opposite side. The fabric is bonded, such as by adhesive or by stitching, to the opposite side of the netting part way down from its top edge, leaving the fabric covering the bottom portion of the opposite side of the netting bottom edge unattached to the netting. The unattached portion of the fabric, thus, forms a free flap (30).

Figure 2:
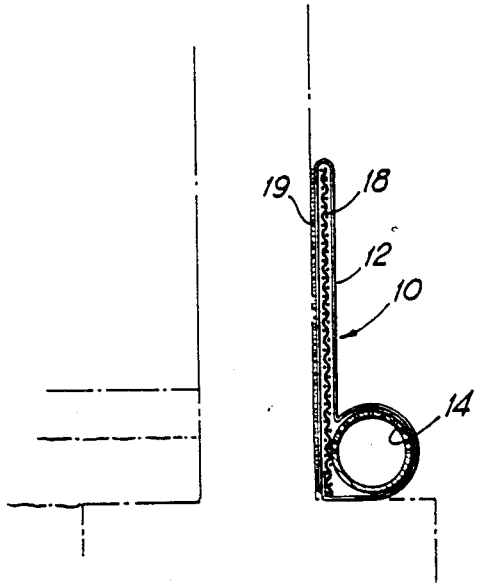
FIG. 2 is a cross-sectional view of the main portion of the drainage system of FIG. 1.

To install the main assembly (10) of the drainage system, the base piece (18) wrapped in the filter fabric is placed along the footing of the foundation and glued (19) in place. The flap is lifted and a drain pipe (14) is placed under the flap along the base piece (18) along the footing of the foundation being drained. The drain pipe (14) is perforated to allow water to enter the pipe from the base piece (18). The flap of filter material is then wrapped around the drain pipe and tucked under the pipe. The weight of the pipe will ordinarily hold the flap in place. The flap may additionally be glued in place if desired. FIG. 2 illustrates a cross-section of the main assembly including the base piece, filter fabric and drain pipe after installation along a foundation footing.

Extending substantially perpendicularly from the main assembly (10) are chimneys or columns (20) spaced ideally four to six feet apart from center to center along the main assembly. The chimneys are preferably spaced on four foot centers in clay soil and on six foot centers in sandy soil, and are approximately six inches wide. The chimneys consist of a piece of textured netting (22) of flexible waterproof material covered with a chimney envelope (24) wrapped around the netting. The chimney netting and fabric are preferably of the same materials as the main assembly. The envelope (24) has a flap (26) of excess material extending from the chimney and folded over to finish off the top of the chimney to prevent soil intrusion into the drain core or netting material. The chimney columns (20) are attached to the foundation wall by glue and preferably should extend from about twelve inches minimum below the backfill line for the soil down to and overlap (28) the top of the main assembly (10) by about four inches.

Suitable adhesives for the main assembly (10) and chimneys (20) include panel or foam board adhesives, spray adhesives or other water proofing mastics, such as as Max Bond Construction Adhesive manufactured by H. B. Fuller Co., Shur Stick 94 by Gibson-Homans and Super 77 spray by 3M. The netting material (18) and (22) which serves as the core for the main assembly (10) and the chimneys (20) can be any flexible, high profile, pervious sheet material which is either extruded or molded. The drain pipe (14) can be either corrugated or slotted or other perforated drain pipe made of a plastic material such as PVC, polyethylene, or other durable, corrosive resistant material. The drain pipe can also be of clay.

Figure 4:
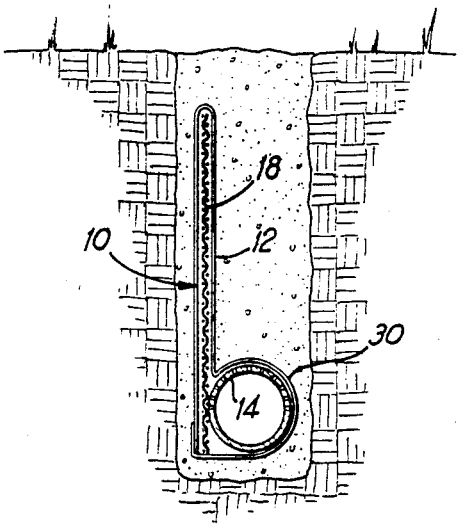
FIG. 4 is a cross-sectional view of the drainage system of the present invention being used as a trench drain.

As illustrated in FIG. 4, to use the drainage system of the present invention as a trench drain, a trench having approximately a 1% slope is dug and the main assembly (10), without chimneys, is inserted into the trench. The trench should be deep enough so that the top of the main assembly (10) is below the backfill line for the soil. In its preferred form the trench should be about six inches wide and about eighteen inches deep. When used as a trench drain, the flap (30) should be wrapped around the drain pipe (14) and glued to the opposite side of the base piece (18) before the main assembly (10) is inserted into the trench.

Figure 5:
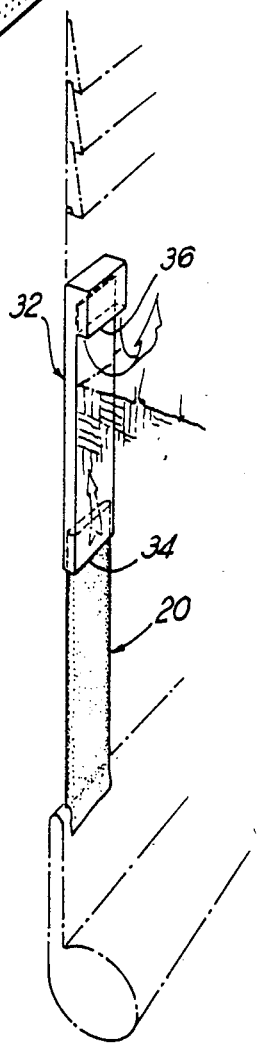
FIG. 5 is a further embodiment of the present invention including a vent for radon gas.

Shown in FIG. 5, is a further embodiment of the present invention allowing for ventilation of underground radon gas. To accomplish this, one or more vents (32) are provided in the form of hollow, substantially rectangularly shaped ducts open at both ends. One end (34) is shaped to fit over the top of chimney (20), overlapping the chimney by about two inches (2") or more. The end (36) of the vent extending above ground is curved or folded over to prevent water migration down the vent. The downturned open end (36) of the vent extends a minimum of about two inches above the soil surface. The vent is preferably an injection molded, impermeable plastic material also glued to the foundation wall which allows radon gas to pass from the chimney (20) and prevents soil and/or water from intruding into the chimney by passage through the wall of the vent pipe. It should be noted that some water will enter from the top of vent despite the curved or folded shape of the end (36). This will occur particularly in inclement weather. When fitted with a vent, the top of the chimney is left open, instead of the filter fabric being folded over. In this way, the chimney/vent assembly allows water which has entered from the top of the vent to flow down the chimney to the drain pipe and gas to flow up the chimney.

From the foregoing detailed description it is seen that the present invention provides a ground water drainage system which makes efficient use of the materials and which allows for ease of installation. When used with a below grade foundation the invention effectively removes ground water away from the foundation, eliminating hydrostatic pressure against the foundation and maintaining a dry foundation interior. The filter fabric prevents blockage of the system by filtering out small soil particles forming a "filter cake" or "soil bridge" across the openings of the fabric. the filter cake prevents clogging of the drain and assures that the drain will continue to perform indefinitely.

It is to be understood that the form of the invention herewith shown and described is to be taken as a preferred example of the same, and that various changes in the shape, size, material, arrangement and assembly method of parts may be resorted to without departing from the spirit of the invention or scope of the subjoined claims.

I claim:

1. A composite drainage and gas venting system for draining below grade ground water and venting radon gas comprising a substantially rectangularly shaped base piece made of a flexible, porous material, said base piece having a top edge and a bottom edge and being longer than it is tall, filter fabric material wrapped around and substantially encasing the base piece, a plurality of chimney assemblies spaced along said base piece and extending substantially perpendicularly thereto, each said chimney assembly being comprised of a narrow elongated sheet of flexible, corrosive-resistant, porous material and filter fabric wrapped around said narrow elongated sheet for channeling water down to the base piece for drainage; and; a vent extending from the top of one or more of the chimney assemblies above the surface of the soil placed over the drainage system.

2. A composite drainage and gas venting system for drawing water away from a foundation wall and releasing gas to the atmosphere comprising:

(a) an elongated drain pipe perforated along its top and side portions extending along the bottom of a subterranean foundation walls;

(b) an elongated substantially rectangular base sheet structure which is impervious to water, corrosive resistant, and has a surface containing raised and lowered portions and perforations therein, said base sheet structure being positioned adjacent the subterranean foundation wall between the wall and said drain pipe;

(c) a base envelope of a non-woven filter fabric which is wrapped around and secured to said base sheet structure such that the side of the base sheet structure adjacent the foundation wall is completely covered by said base envelope and the opposite side of said base sheet structure is covered by said base envelope and secured thereto at a point approximately equal to the height of said drainpipe or lower whereby the remainder of said envelope is drawn around and covers said drain pipe and extends to the initial side of said base sheet structure adjacent said wall;

(d) a plurality of narrow chimney sheet structures of like material as said base sheet structure touching the top of and spaced along said base sheet structure extending upwardly through said envelope against the foundation wall;

(e) a plurality of chimney envelopes of a non-woven filter fabric, said chimney sheet structures being encased by said chimney envelopes, said envelopes with said flaps being attached to said base envelope; and (f) a plurality of vent pipes extending over said encased chimney sheet structures and extending upward through the soil adjacent the foundation wall such that said vent pipes may vent gaseous contents to the atmosphere.

3. A composite drainage and gas venting system as defined in claim 2 where said vent pipe is curved such that the vent is perpendicular with the ground thereby preventing the intrusion of water and or solid material within said pipe.

* * * * *